US009334108B2

(12) United States Patent
David et al.

(10) Patent No.: US 9,334,108 B2
(45) Date of Patent: May 10, 2016

(54) TANK MANWAY WITH NON-CORROSIVE COVER

(71) Applicant: Clay and Bailey Manufacturing Company, Kansas City, MO (US)

(72) Inventors: Donald R. David, Raytown, MO (US); Bradford E. Holmes, Lee's Summit, MO (US)

(73) Assignee: Clay and Bailey Manufacturing Company, Kansas City, MO (US)

( * ) Notice: Subject to any disclaimer, the term of this patent is extended or adjusted under 35 U.S.C. 154(b) by 209 days.

(21) Appl. No.: 13/895,042

(22) Filed: May 15, 2013

(65) Prior Publication Data

US 2014/0237902 A1 Aug. 28, 2014

Related U.S. Application Data

(60) Provisional application No. 61/770,909, filed on Feb. 28, 2013.

(51) Int. Cl.
*B65D 90/10* (2006.01)

(52) U.S. Cl.
CPC ..... *B65D 90/10* (2013.01)

(58) Field of Classification Search
IPC . B65D 90/10,90/105, 90/54; F16J 13/16; E06B 2003/7084, 2003/7082
See application file for complete search history.

(56) References Cited

U.S. PATENT DOCUMENTS

| | | | | | |
|---|---|---|---|---|---|
| 3,318,064 | A * | 5/1967 | Mayfield | B64G 1/58 | 52/794.1 |
| 4,081,107 | A * | 3/1978 | Martin et al. | 220/374 | |
| 4,461,219 | A * | 7/1984 | Bateson | 105/377.07 | |
| 4,788,088 | A * | 11/1988 | Kohl | 428/34.5 | |
| 5,160,772 | A * | 11/1992 | Futami | B29C 70/26 | 428/318.8 |
| 5,425,466 | A * | 6/1995 | Bambacigno | 220/203.09 | |
| 6,651,708 | B2 * | 11/2003 | Gloor | B60P 3/226 | 141/360 |
| 2005/0028946 | A1 * | 2/2005 | Weishar et al. | 160/214 | |
| 2011/0011464 | A1 * | 1/2011 | Lauber et al. | 137/171 | |
| 2012/0094068 | A1 * | 4/2012 | Wortelboer | 428/140 | |

FOREIGN PATENT DOCUMENTS

EP 2 036 836 * 3/2009

* cited by examiner

*Primary Examiner* — Gregory Strimbu
(74) *Attorney, Agent, or Firm* — Hovey Williams LLP

(57) ABSTRACT

A manway hatch is used with a tank defining a chamber in which fluid is stored and/or transported. The manway hatch comprises a base and a cover. The base is configured to be fixed to the tank and defines an opening configured to communicate with the tank chamber. The cover is movably positioned in a covering relationship with the opening and presents an inner cover surface facing the tank chamber. The inner surface is formed at least substantially of a synthetic resin or other non-corrosive material.

11 Claims, 9 Drawing Sheets

TANK MANWAY WITH NON-CORROSIVE COVER

CROSS-REFERENCE TO RELATED APPLICATIONS

The present application claims priority from U.S. Provisional Application No. 61/770,909, filed Feb. 28, 2013, the entire disclosure of which is hereby incorporated by reference herein.

BACKGROUND OF THE INVENTION

1. Field of the Invention

The present invention relates generally to a manway hatch. More particularly, the present invention concerns a manway hatch associated with a tank for storage and/or transport of a fluid.

2. Discussion of the Prior Art

Those of ordinary skill in the art will appreciate that manway hatches are often used to enable controlled access to storage and/or transport tanks. Such tanks may contain fluids that lead to degradation of exposed metal of conventional manway covers.

SUMMARY

According to one aspect of the present invention, a manway hatch is provided for use with a tank defining a chamber in which fluid is stored and/or transported. The manway hatch comprises a base and a cover. The base is configured to be fixed to the tank. The base defines an opening configured to communicate with the tank chamber. The cover is removably positioned in a covering relationship with the opening in the base. The cover includes a metal plate at least substantially spanning the opening, and a corrosion-resistant shell encapsulating the plate, such that the shell isolates the plate from the fluid.

According to another aspect of the present invention, a manway hatch is provided for use with a tank defining a chamber in which fluid is stored and/or transported. The manyway hatch comprises a base, a cover, and a multi-stage latch mechanism. The base is configured to be fixed to the tank. The base defines an opening configured to communicate with the tank chamber. The cover is shiftable between a closed position, in which the cover sealingly engages the base in a covering relationship with the opening, and an open position, in which the opening is substantially unobstructed by the cover so as to permit chamber ingress and egress through the opening. The cover presents an inner cover surface that generally faces the opening when the cover is in the closed position. The base and the inner cover surface are at least substantially formed of a synthetic resin. The latch mechanism is shiftable amongst a latched condition, an intermediate venting condition, and an unlatched condition. The latch mechanism secures the cover in the closed position when the latch mechanism is in the latched condition. The latch mechanism permits at least substantially unrestricted shifting of the cover to the open position when the latch mechanism is in the unlatched condition. The latch mechanism permits limited shifting of the cover out of the closed position, such that pressure from the chamber may be released through the opening while the cover is prevented from shifting to the open position, when the latch mechanism is in the venting condition.

According to yet another aspect of the present invention, a manway hatch is provided for use with a tank defining a chamber in which fluid is stored and/or transported. The manway hatch comprises a base and a cover. The base is configured to be fixed to the tank. The base defines an opening configured to communicate with the tank chamber. The cover is shiftable between a closed position, in which the cover is in a covering relationship with the opening in the base, and an open position, in which the opening is substantially unobstructed by the cover so as to permit chamber ingress and egress through the opening. The cover presents an inner cover surface that generally faces the opening when the cover is in the closed position. The base and the inner cover surface are at least substantially formed of a synthetic resin. The cover includes a drip lip projecting from the inner cover surface, such that the drip lip extends into the opening when the cover is in the closed position and at least in part over the opening when the cover is in the open position.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 1:
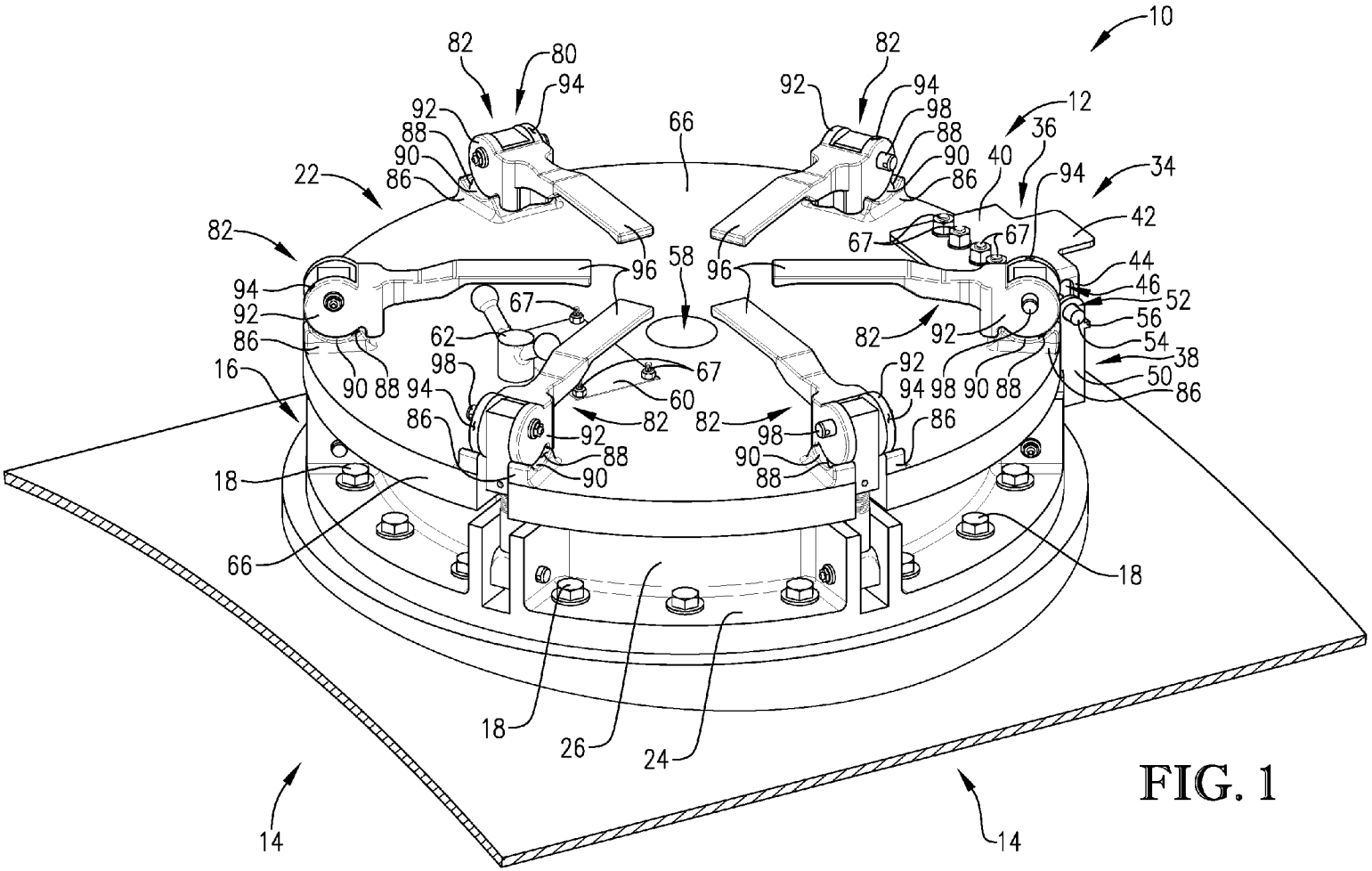
FIG. 1 is a top perspective view of a portion of a tank and a manway hatch constructed in accordance with a preferred embodiment of the present invention.
Figure 2:
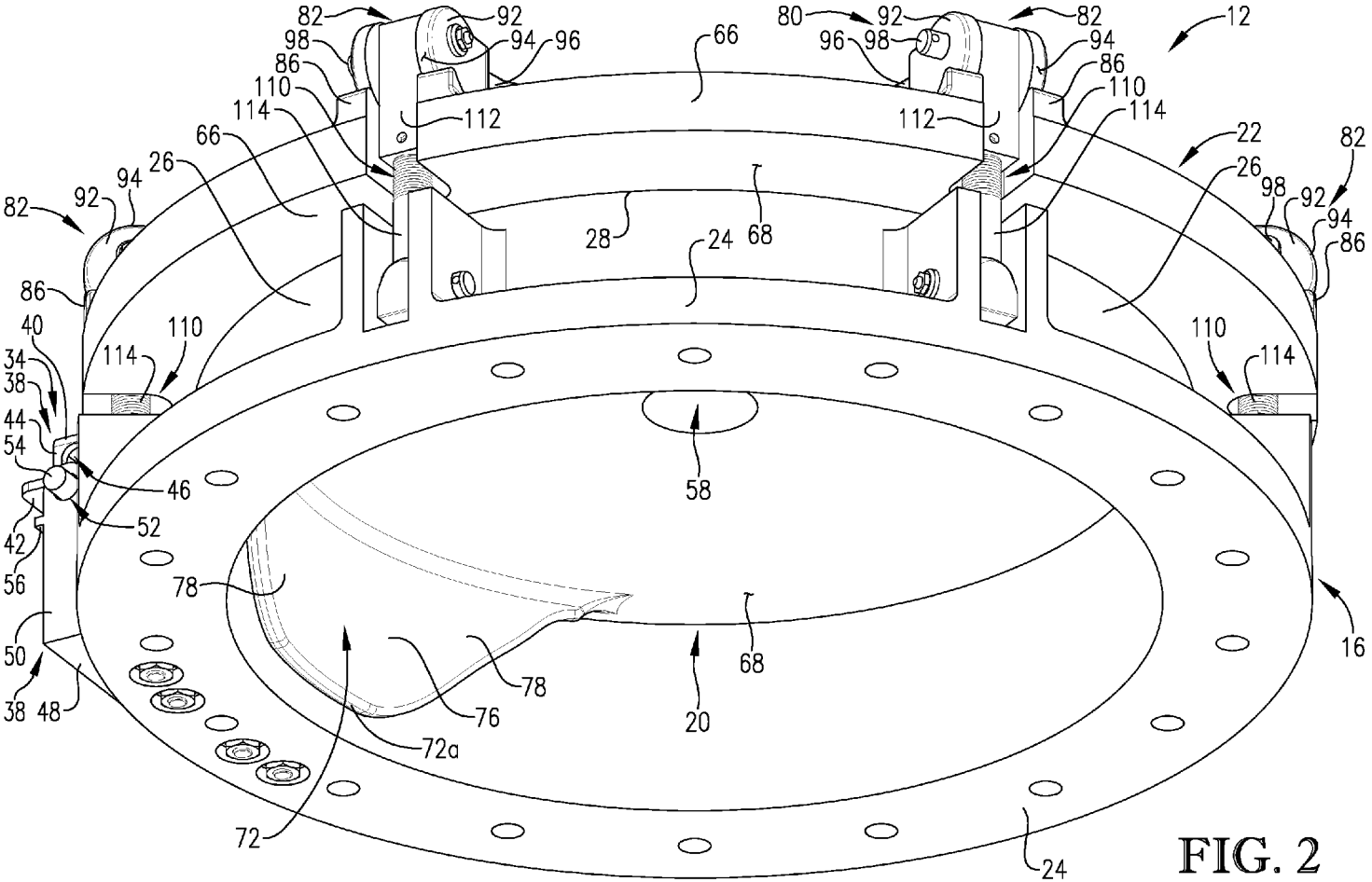
FIG. 2 is a bottom perspective view of the manway hatch of FIG. 1.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

With initial reference to FIG. 1, a tank 10 including a manway hatch 12 constructed in accordance with a preferred embodiment of the present invention is depicted. The tank 10 preferably defines a chamber 14 for storage and/or transport of fluid, although it is permissible for the tank to be configured for any storage and/or transport means. For instance, the tank might be configured for storage and/or transport of a gas.

In a preferred embodiment, the tank 10 and the chamber 14 are configured to store and/or transport oil field fluids, such as acids or petroleum. Such fluids may in some instances be caustic or have other properties which may lead to damage or degradation of certain materials brought into contact with the fluid. For instance, a fluid that causes corrosion of metal might suitably be contained in the tank 10.

The hatch 12 preferably includes a base 16 fixed to the tank 10 via fasteners 18. The base 16 defines an opening 20 that communicates with the tank chamber 14. The hatch 12 further preferably includes a cover 22 that is removably positioned in a covering relationship with the opening 20 in the base 16. Preferably, the cover 22 at least substantially spans the entirety of the opening 20. Most preferably, the cover 22 sealingly engages the base 16 when closed so that communication with the chamber 14 (through the opening 20) is prevented, as will be subsequently described.

Figure 5:
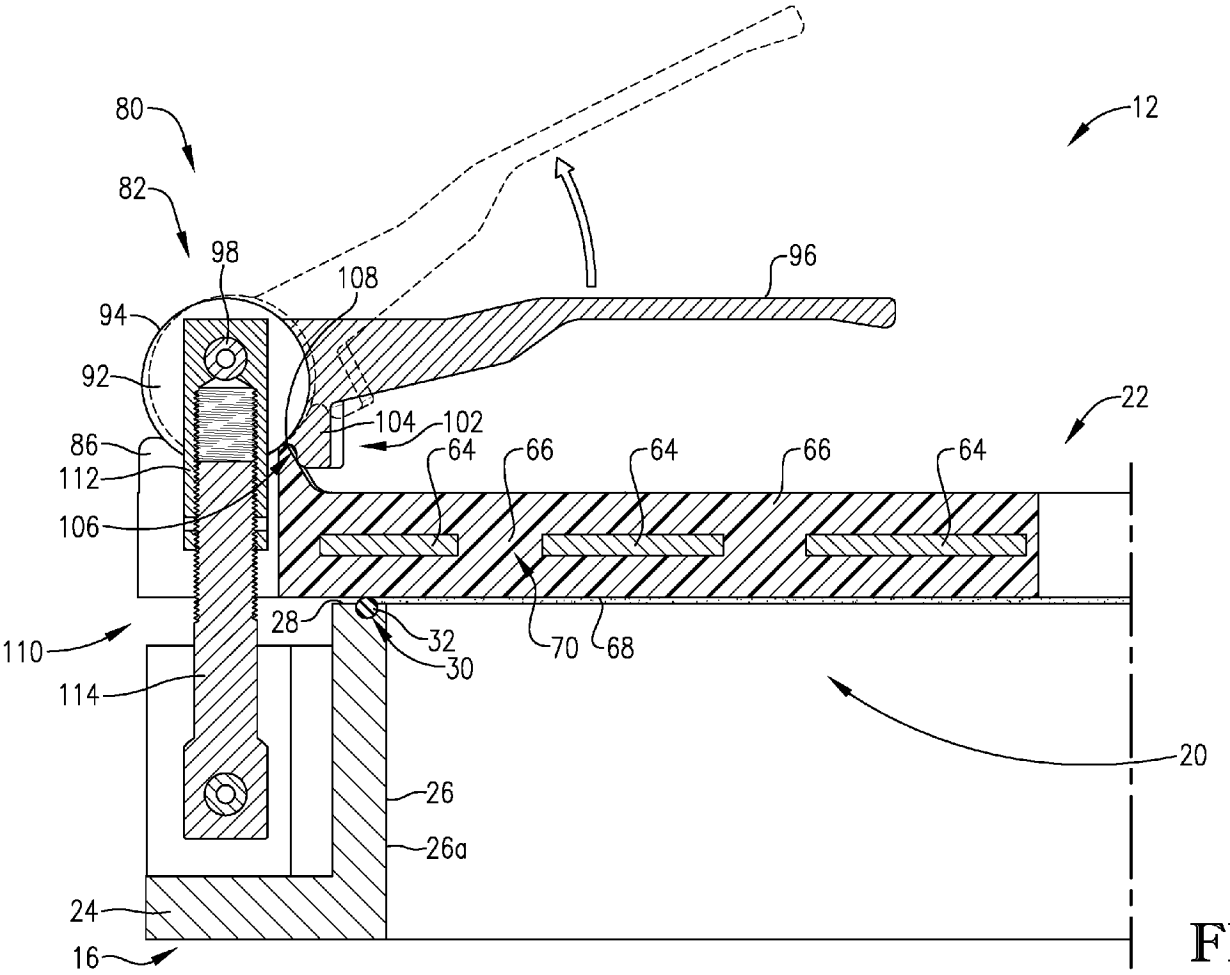
FIG. 5 is a fragmentary cross-sectional view the manway hatch of FIGS. 1-4, particularly illustrating a closed latch component condition.

In a preferred embodiment, the base 16 includes a generally annular flange 24 and a sidewall 26 extending generally orthogonally from the flange 24 and presenting an outer end 28. The sidewall 26 includes an inner surface 26*a* that defines at least in part the opening 20. A groove 30 is preferably formed in the outer end 28 of the sidewall 26, and a gasket 32 is preferably received in the groove 30. As best shown in FIG. 5, the gasket 32 preferably provides a seal between the cover 22 and the sidewall 26 when the cover 22 is in the closed position. It is noted that FIG. 5 is a schematic illustration of this seal. That is, it is preferable that the fit between the cover 22 and the base 16 be tight enough to deform the gasket, in contrast to the "just-contacting" configuration shown in FIG. 5 for the sake of clarity.

The hatch 12 is preferably generally circular in shape, although any one or more of a variety of shapes may be suitable. For instance, the hatch might be generally rectangular, octagonal, or elliptical without departing from the scope of the present invention. It is also permissible within some aspects of the present invention for the cover to be of a different general shape than the base while still at least substantially spanning the entirety of the opening.

A hinge assembly 34 preferably pivotally couples the cover 22 to the base 16, such that the cover 22 is pivotable between a closed position (see, for instance, FIG. 1), in which the cover sealingly engages the base 16 in a covering relationship with the opening 20, and an open position (see, for instance, FIG. 8), in which the cover 22 is out of the covering relationship with the opening 20 such that the opening 20 is substantially unobstructed by the cover 22 so as to permit chamber 14 ingress and egress through the opening 20. Intermediate cover positions are also permissible and will be discussed in more detail below.

It is also permissible for the cover 22 and the base 16 to be coupled in a non-hinged manner or to lack coupling mechanisms.

Figure 3:
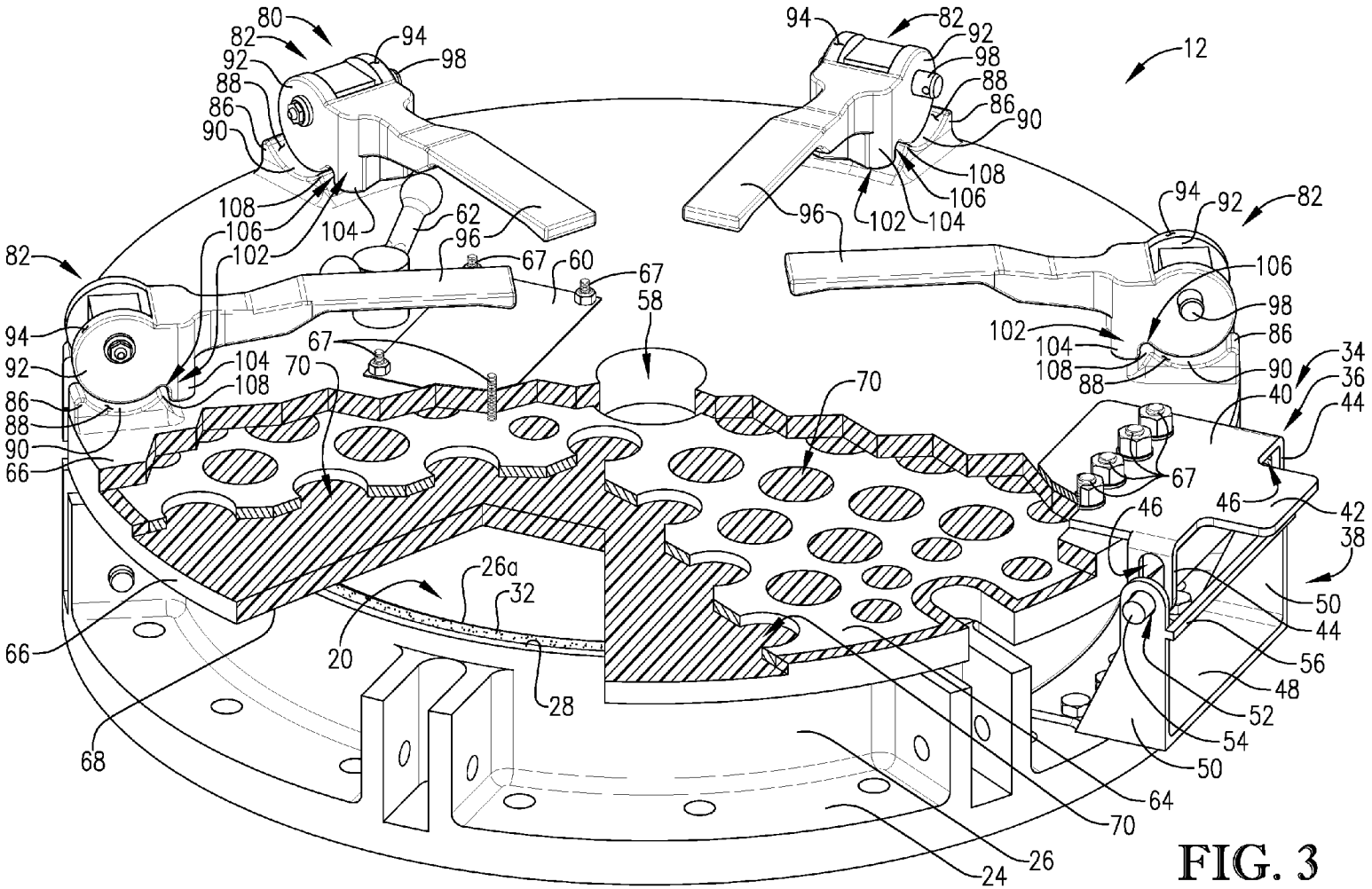
FIG. 3 is a partially sectioned top perspective view of the manway hatch of FIGS. 1 and 2, particularly illustrating the integration of the reinforcement plate in the cover.

As best shown in FIG. 3, the hinge assembly 34 preferably includes an upper bracket 36 fixed to the cover 22 and a lower bracket 38 fixed to the base 16. The upper bracket 36 preferably includes an upper plate 40, a tab 42 extending generally radially outwardly from the upper plate 40, and a pair of upper arms 44 extending from the upper plate 40 toward the lower bracket 38. Each of the upper arms 44 preferably defines an elongated slot 46. The lower bracket 38 preferably includes a lower plate 48 and a pair of lower arms 50 extending from the lower plate 48 toward the upper bracket 36. Each of the lower arms 50 preferably defines a hole 52. A hinge pin 54 preferably extends through the holes 52 and the slots 46 to pivotally interconnect the upper bracket 36 and the lower bracket 38.

Figure 8:
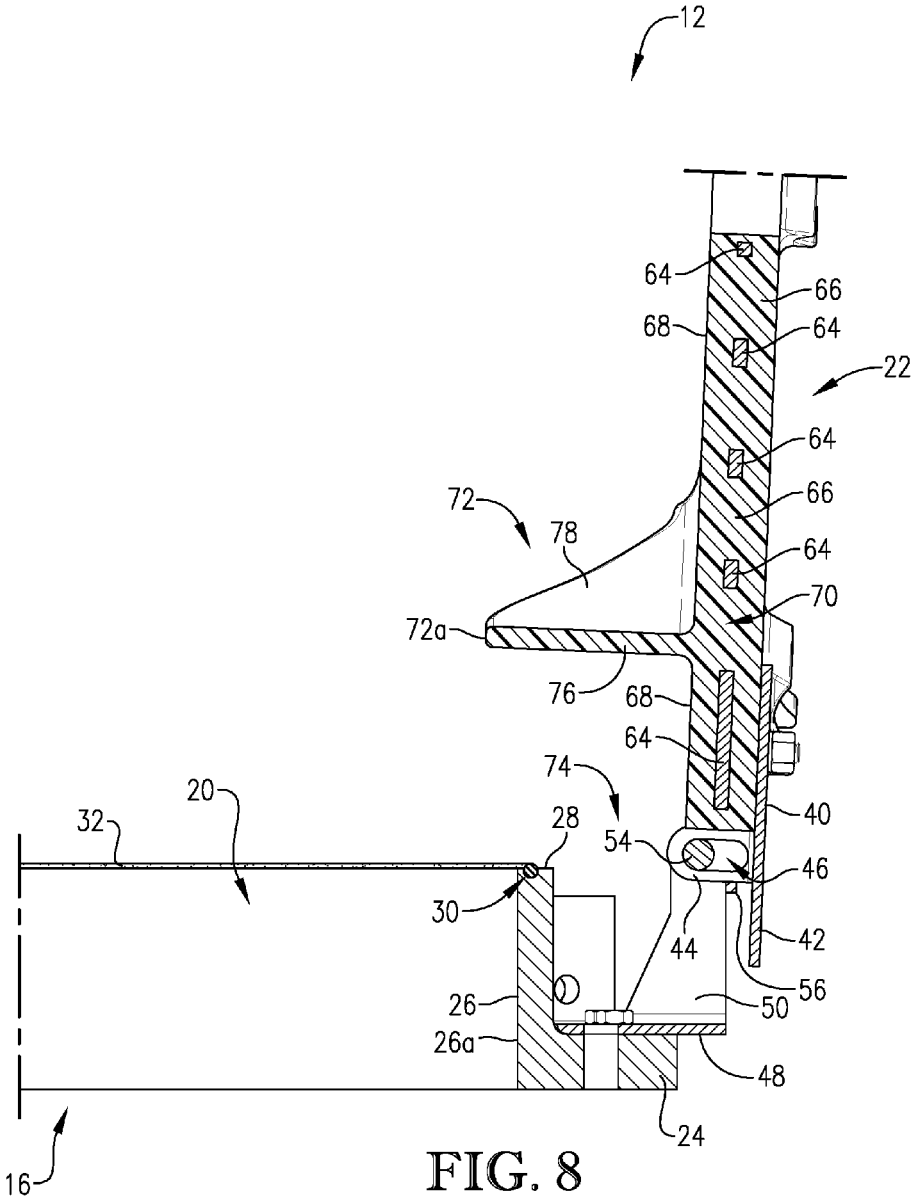
FIG. 8 is a cross-sectional view of the portion of the manway hatch of FIG. 7, particularly illustrating the cover in a fully open cover position.

In a preferred embodiment, the lower bracket 38 further includes a stopper bar 56 extending between and interconnecting the lower arms 50. As best shown in FIG. 8, contact between the stopper bar 56 and the upper arms 44 of the upper bracket 36 preferably prohibits pivoting of the cover 22 relative to the base 16 past a generally orthogonal open position (see FIG. 8). However, it is permissible for no stopping mechanism to be provided or for a stopping mechanism to be provided that is configured to prohibit movement past a different angle. An alternatively configured stopping mechanism might be provided, as well.

In a preferred embodiment, a vent 58 is provided in the cover 22. The vent 58 is preferably configured to release overly high pressure in the chamber 14. In preferred embodiment, the vent 58 is configured to operate when pressure in the chamber 14 reaches 6 psi. It is permissible, however, for the cover 22 to be devoid of a vent or for a vent to be provided that is operational at a different threshold pressure. It is also permissible for the vent to be of any kind known in the art without departing from the scope of the present invention.

The cover 22 also preferably includes an information plate 60. The information plate 60 may suitably include information regarding the manufacturer of the hatch 12 and/or the tank 10, the company that owns the tank 10, the contents of the tank 10, etc. It is also permissible for more information plates or no information plates to be provided.

Still further, the cover 22 preferably includes a handle 62 configured to be grasped by a user during opening of the cover 22, as will be discussed in more detail below. Any type of suitable handle known in the art is permissible without departing from the scope of the present invention.

In a preferred embodiment, the cover 22 includes a metal plate 64 at least substantially spanning the opening 20 and a shell 66 encapsulating the plate 64, such that the shell 66 isolates the plate from the fluid. It is also permissible according to some aspects of the present invention for the plate to span less than a substantial part of the opening or be eliminated altogether.

The plate 64 is preferably molded in the shell 66, although other means of encapsulation are permissible without departing from the scope of the present invention. For instance, the shell might includes two halves that are secured about the plate.

In a preferred embodiment, the shell 66 is at least substantially formed of a corrosion-resistant material, where the term corrosion is to be broadly interpreted as potentially including any form of chemical degradation due to interactions with the environment. The exact substance against which the shell 66 should be resistant will vary according to the particular application for which the tank 10 is being used and is not necessarily limited substances in a particular state of matter (e.g., liquids or gases). However, it is noted that the preferred embodiment is especially suitable for use with oil and other forms of liquid fossil fuel and related materials.

Figure 7:
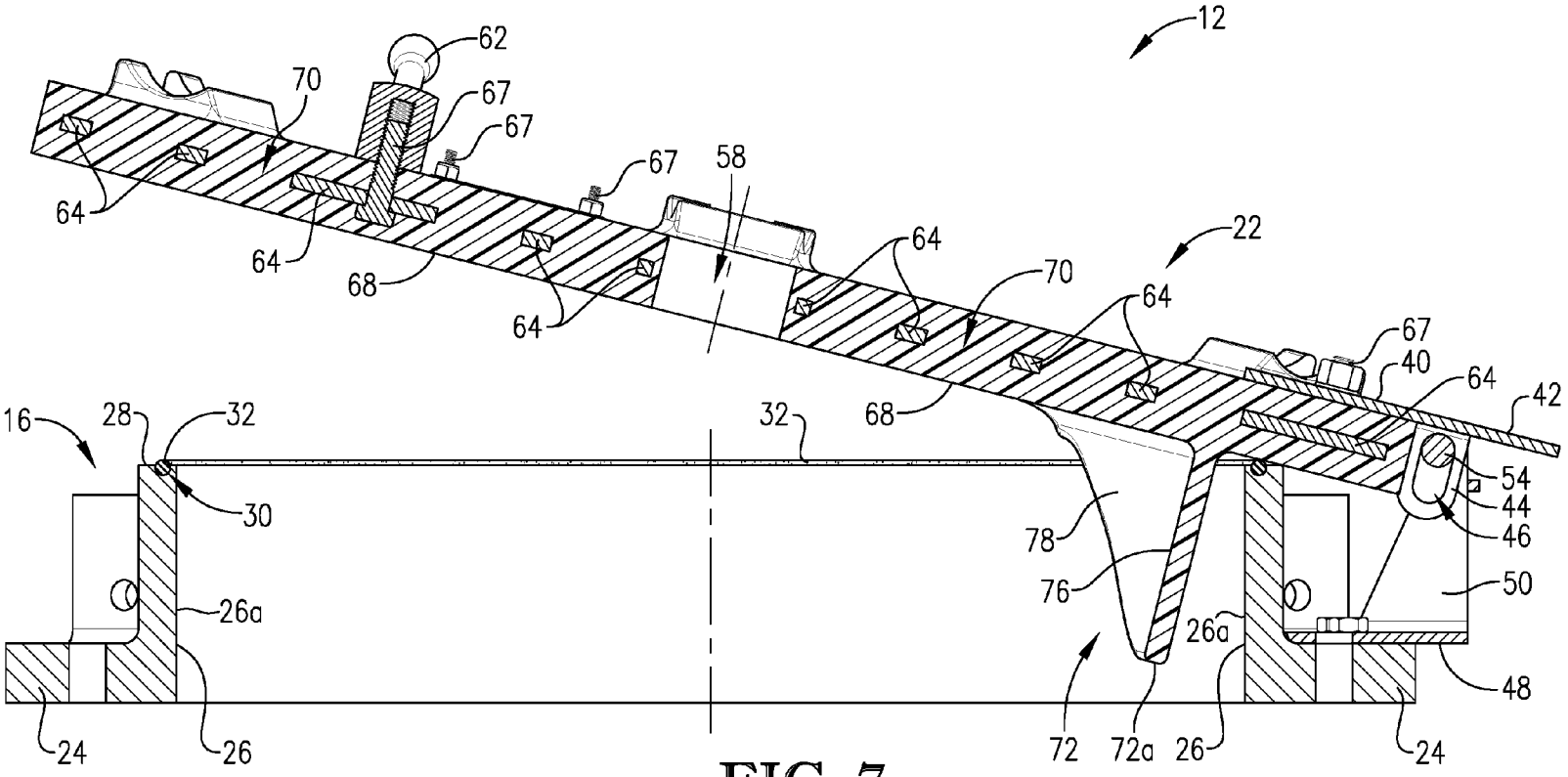
FIG. 7 is a cross-sectional view of a portion of the manway hatch of FIGS. 1-3, particularly illustrating the cover in a partially open cover position.

As best shown in FIGS. 1, 3, 4 and 7, the plate 64 is additionally secured relative to the shell 66 by a plurality of fasteners 67 that project from the plate 64 and at least partially through the shell 66. The fasteners 67 are preferably threaded fasteners. Most preferably, the fasteners 67 project from the plate 64, at least partially through the shell 66, into corresponding ones of the handle 62, the upper plate 40 of the hinge assembly 34, and the information plate 60. As shown in FIG. 7, at least one of the fasteners 67 extends through the plate 64 (see the fastener 67 attaching the handle 62 to the plate 64).

In a preferred embodiment, the plate 64 is at least substantially formed of stainless steel, while the shell 66 is at least substantially formed of a synthetic resin. More preferably, the shell is at least substantially formed of ultra high molecular weight polyethylene (UHMWPE). The base 16 is likewise preferably at least substantially formed of a synthetic resin such as UHMWPE. However, any one or more of a variety of materials may be suitable.

For instance, a suitable alternative for the UHMWPE might be a material having characteristics such as the following: a weight-average molecular weight of the order of 1×10^6 g/mol, a density of approximately 1 gm/cm^3, high abrasion resistance and impact strength (e.g., 30 ft. lb/in. at room temperature), low coefficients of static and/or dynamic friction, and resistance to selected chemicals of relevance. Variations from the above are permissible, however, with the most critical feature being that the material of the shell is at least substantially resistant to degradation by the fluid carried in the chamber of the tank.

It is also permissible according to some aspects of the present invention for only a portion of the shell 66 to be at least substantially formed of UHMWPE or a similar material. For instance, in a preferred embodiment, the shell 66 presents an inner shell surface 68 that generally faces the opening 20 when the cover 22 is in the closed position. It is permissible according to some aspects of the present invention for only the inner shell surface, which is the most likely portion of the cover to come into contact with the fluid, to be at least substantially formed of UHMWPE or a similar material. In such an embodiment, generally non-fluid-contacting portions of the cover might be formed of an entirely different material.

A suitable alternative for the stainless steel might be any material having mechanical properties capable of withstanding the pressures exerted by a fluid in the tank and any pressures or forces exerted on the cover during operation of the hatch or during usage of the tank.

Figure 4:
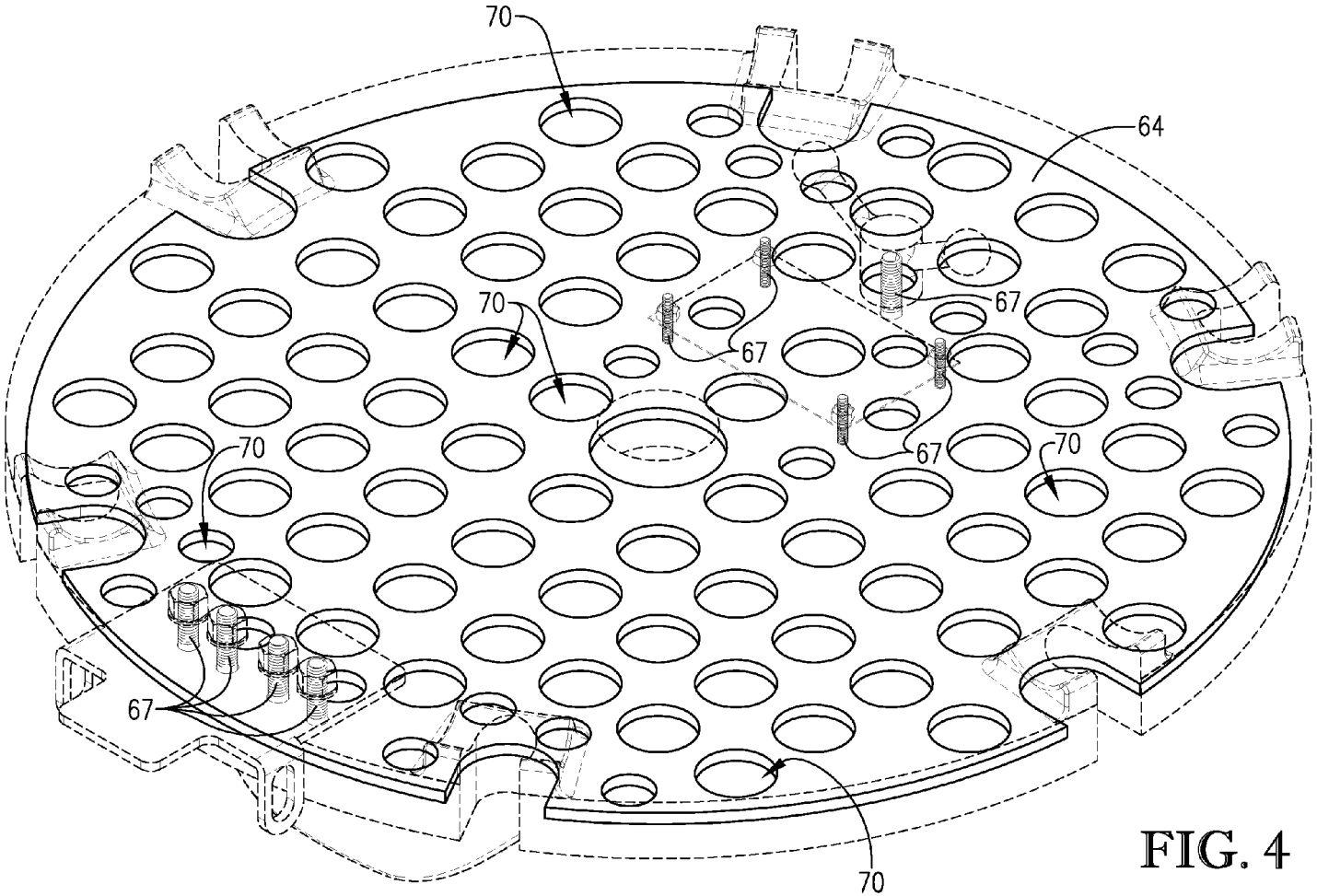
FIG. 4 is a top perspective view of the reinforcement plate of the manway hatch of FIGS. 1-3.

In a preferred embodiment, as best shown in FIGS. 3 and 4, the plate 64 defines a plurality of perforations 70 therethrough. The shell 66 preferably fills each of said perforations 70. The perforations 70 thus serve to decrease the weight of the plate 64 and to allow additional securing of the plate 64 in the shell 66. It is permissible, however, for the plate to be devoid of perforations or to include more or fewer perforations without departing from the scope of the present invention. It is also permissible for the perforations to be of any shape or of a variety of shapes. Rather than the preferred circular perforations, for instance, the perforations could be in the form of slits or in the form of both slits and circles. A variety of sizes and densities are permissible, as well.

In a preferred embodiment, the cover 22 further includes a drip lip 72 extending generally orthogonally from the inner shell surface 68, such that the drip lip 72 extends into the opening 20 when the cover is in the closed position and at least in part over the opening 20 when the cover 22 is in a fully open position. With respect to the fully open position, as best shown in FIG. 8, it is noted that the inner shell surface 68 is laterally offset from the opening 20 (or, more particularly, from the inner surface of the sidewall) such that a lateral gap 74 is defined therebetween. Preferably, the drip lip 72 extends across the lateral gap 74 toward the sidewall 26 of the base 16 and presents an end 72*a* that extends radially inwardly of the sidewall 26.

In a partially open position, as best shown in FIG. 7, the end 72*a* remains inside the opening 20.

Preferably, the drip lip 72 is positioned adjacent the hinge assembly 34. Such positioning provides protection for the hinge assembly against the dripping of fluids thereonto and ensures that the drip lip is adjacent the lowermost end of the cover surface when the cover 22 is open. It is permissible within the scope of certain aspects of the present invention, however, for the drip lip to be positioned elsewhere relative to the hinge assembly.

Preferably, the drip lip 72 comprises a curved body 76 including side retaining walls 78. In a preferred embodiment, the retaining walls 78 retain fluid on the body 76 of the drip lip 72 or, if the cover 22 is positioned appropriately, direct fluid toward and over the end 72*a* of the drip lip 72 and into the opening 20 and the chamber 14. Such fluid may be from any source, including but not limited to condensation on the inner shell surface 68. For instance, as shown in FIG. 8, when the cover 22 is in the fully open position and the inner shell surface 68 is thus at least substantially upright, condensation (not shown) on the inner shell surface 68 would flow onto the body 76 of the drip lip 72 and be retained thereon by the retaining walls 78. As shown in FIG. 7, when the cover 22 is moved toward its closed position, thus sloping the drip lip 72 toward the opening, the condensation would be directed over the end 72*a* and into the opening 20 and the chamber 14.

It is permissible according to some aspects of the present invention, however, for the hatch to be devoid of a drip lip, to include multiple drip lips, or to include one or more alternatively configured drip lips.

In a preferred embodiment, the hatch 12 further includes a multi-stage latch mechanism 80 including a plurality of shiftable latch components 82. The latch components 82 are preferably evenly spaced about the perimeter of the cover 22, although uneven spacing and/or other positional variations are permissible.

The latch mechanism 80 is preferably shiftable amongst a latched condition, an intermediate venting condition, and an unlatched condition, each of which will be described in greater detail below. Each of the latch components 82 is preferably shiftable amongst latched, intermediate venting, and unlatched positions which correspond with the latched, venting, and unlatched conditions, respectively, of the latch mechanism 80, with operation of the latch components 82 thereby effecting shifting of the latch mechanism 80 as a whole.

Figure 9:
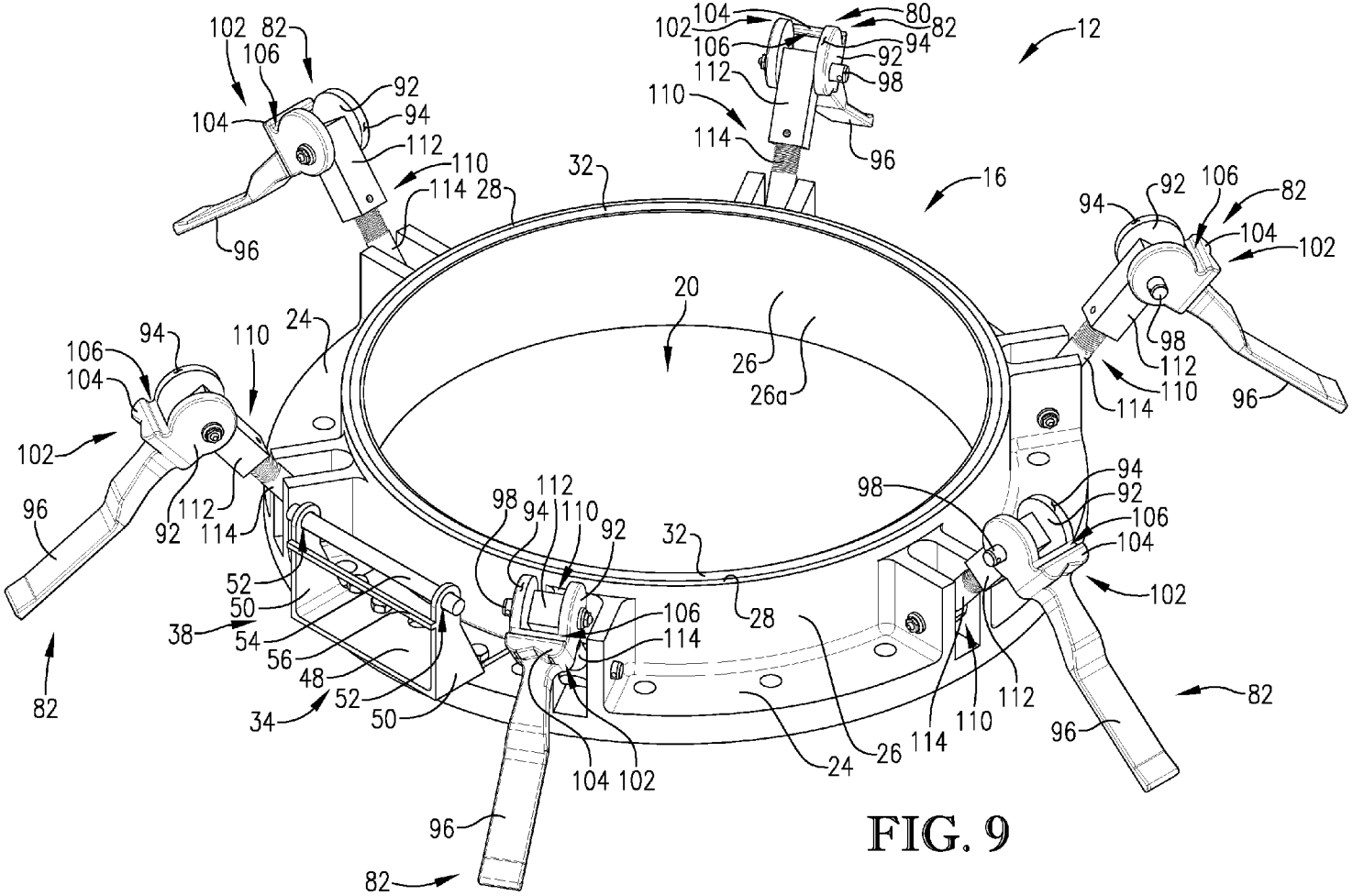
FIG. 9 is a top perspective view of the base and latch components of the manway hatch of FIGS. 1-3, with the cover being removed, particularly illustrating an open latch component condition.

FIGS. 1-3 and 5 illustrate the latched condition, in which the latch mechanism 80 secures the cover 22 in the closed position. FIG. 9 illustrates the unlatched condition, in which the latch mechanism 80 permits at least substantially unrestricted shifting of the cover 22 to the open position (see FIGS. 7 and 8).

As shown in FIG. 5, the latch mechanism 80 is also preferably shiftable to an intermediate venting configuration in which the latch mechanism 80 permits limited shifting of the cover 22 out of the closed position, such that a venting gap 84 is formed between the inner shell surface 68 and the gasket 32, but prevents the cover 22 from shifting to the open position. In this intermediate venting configuration, pressure from the chamber 14 may be released through the venting gap 84 when the latch mechanism 80 and, preferably, the latch components 82 are in the venting condition. It is also permissible for a vacuum in the chamber to be equalized via the venting gap 84.

Preferably, such multi-stage shifting is effected by the use of eccentric disk-and-socket latch components 82. More particularly, in a preferred embodiment, each of the latch components 82 includes a socket 86 presenting a curved surface 88 defining a central point 90. Each socket 86 is preferably integrally formed with the cover 22, although non-integral sockets are permissible. Each latch component 82 further preferably includes a disk element 92 rotatable about an axis and presenting a curved face 94 configured to slidingly engage the curved surface 88 of the socket 86 when the disk element 92 is rotated. A lever 96 preferably extends from each disk element 92, such that swinging of the lever 96 effects rotation of the disk element 92.

Preferably, the curved face 94 of the disk element 92 is eccentric relative to the rotational axis of the disk element 92. That is, the geometric longitudinal axis of the disk element 92 is preferably offset relative to the rotational axis of the disk element 92, such that the distance from the rotational axis of the disk element 92 to the curved face 94 varies in length about the disk element 92. Such eccentricity is readily apparent in FIGS. 1-3, 5, 6, and 9, in which a pin 98 extends through each disk element 92 and marks the axis of rotation of the disk element 92.

Figure 6:
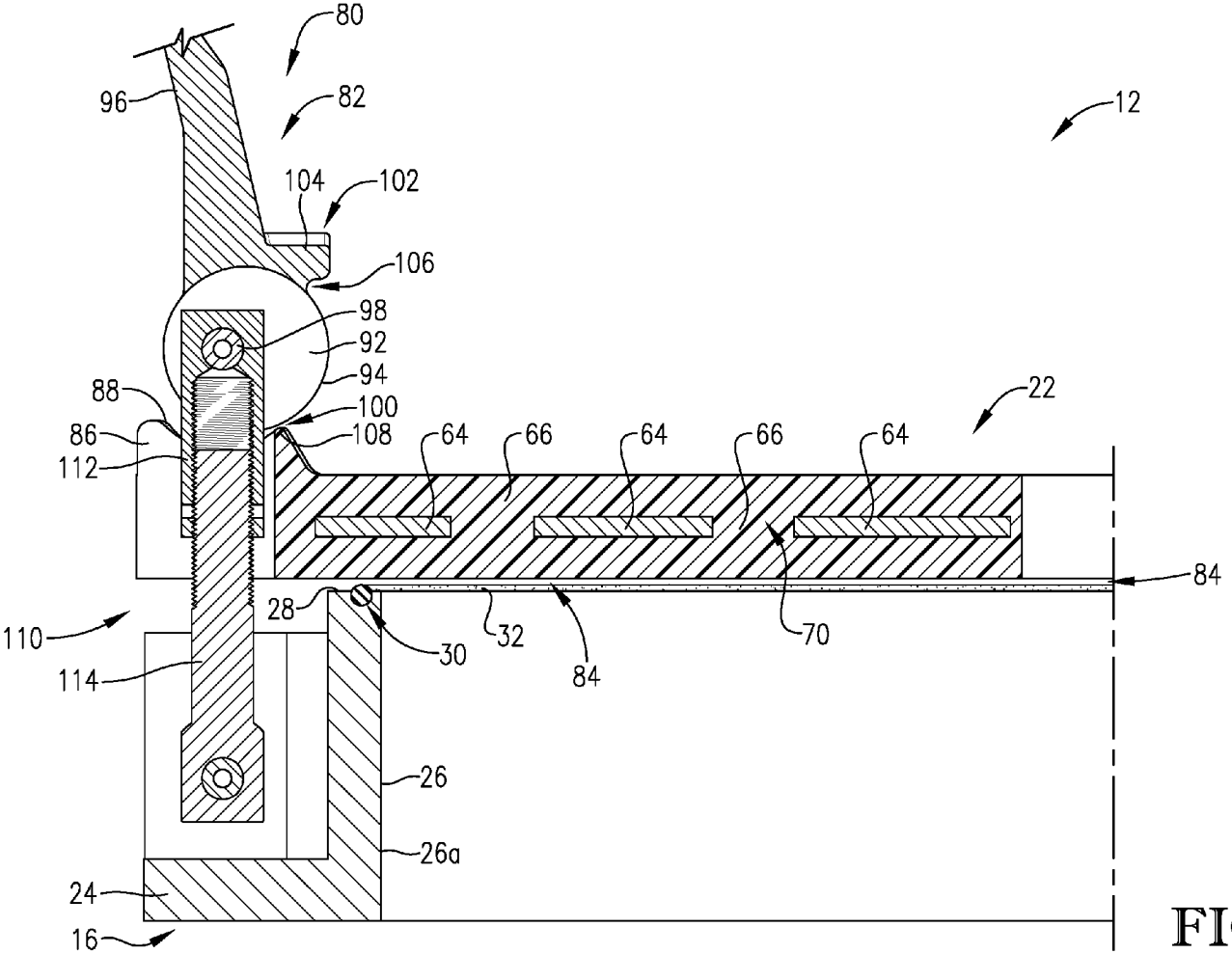
FIG. 6 is a fragmentary cross-sectional view of the portion of the manway hatch similar to FIG. 5, particularly illustrating an intermediate venting latch component condition.

As shown in FIGS. 1-3 and 5, when the latch components 82 are in the latched condition, the distance between the axis of rotation and the portion of the curved face 94 of the respective disk element 92 adjacent the central point 90 of the curved surface 88 of the respective socket 86 is maximized. As the levers 96 and, in turn, the disk elements 92, are rotated, this distance gradually decreases until it is at least substantially minimized, as shown in FIG. 6. This provides a space in which the cover 22 can shift away from the base 16 into an intermediate venting position while still being prevented from shifting all the way into an open position. In FIG. 6, for instance the cover 22 has shifted into the space such that the previously described venting gap 84 is formed between the inner shell surface 68 and the gasket 32, thus enabling communication between the chamber 14 and the atmosphere (and, thus, modulation of the pressure in the tank 10) prior to the full opening of the cover.

In the embodiment illustrated in FIG. 6, a secondary gap 100 is formed between the curved face 94 of the disk element 92 and the curved surface 88 of the socket. In some instances, the secondary gap may be larger or smaller than shown or may be non-existent. For instance, high initial pressures in the chamber might instead result in the cover shifting all the way into contact with the disk elements, eliminating the secondary gap.

In a preferred embodiment, as illustrated, shifting of the latch components 82 from the latched condition to the intermediate venting condition occurs upon rotation the respective disk elements 92 by approximately ninety (90) degrees. However, it is permissible for other amounts of rotation to be required for the shift to occur.

Preferably, shifting of the cover 22 to the intermediate position is enabled without requiring any pivoting of the cover 22 relative to the base 16. More particularly, the slot 46 in each arm 44 of the upper hinge bracket 36 is preferably configured to accommodate such shifting of the cover 22, with the position of the hinge pin 54 in the slot 46 varying according to the position of the cover 22 relative to the base 16. It is permissible, however, for other shifting accommodations to be used, including those requiring pivoting.

In a preferred embodiment, each of the latch components 82 includes a catch mechanism 102 including a projection 104 extending from the interface between the lever 96 and the disk element 92. The projection 104 defines a recess 106 configured to receive an end portion 108 of the corresponding socket 86 such that the lever 96 and the disk element 92 of each latch component 82 is removably retained relative to the corresponding socket 86 by the interengagement of the projection 104 and the end portion 108.

In a preferred embodiment, each of the latch components 82 is adjustable so as to vary the location of the disk element 92 relative to the socket 86 when the latch component 82 is in the latched and venting positions. Preferably, such adjustability is afforded by a corresponding nut and bolt assembly 110 connecting the latch component 82 to the base 16. As best shown in FIGS. 5 and 6, each nut and bolt assembly 110 preferably includes a nut 112 threadably interconnected with a bolt 114. The pin 98 about which the disk element 92 rotates preferably extends through the nut 112, while the bolt 114 is preferably pivotally fixed to the base 16. Tightening of the nut 112 relative to the bolt 114 prior to assembly of the latch component 82 thus positions the latch component 82 closer to the base 16. The cover 22 is therefore secured more tightly to the base 16 when the latch mechanism 80 is in the latched configuration and is retained more closely to the base 16 (albeit with the venting gap 84 therebetween) when the latch mechanism is in the intermediate venting configuration. Loosening of the nut 112 preferably has an opposite effect.

Preferably, positioning of the nut 112 above the bolt 114 reduces the risk of contaminant ingress into the nut 112 and subsequent locking thereof.

As shown in FIG. 9, when the latch components 82 are in the open configuration, they may be shifted radially outwardly via pivoting of the bolts 114 relative to the base 16. Such pivoting enables the latch components 82 to be positioned in a manner such that they do not obstruct the opening 20.

Although the above-described latch mechanism 80 is preferred, it is permissible within the scope of some aspects of the present invention for an alternatively configured latch mechanism to be provided. It is also permissible according to some aspects of the present invention for dual-stage latch mechanisms to be provided, for the hatch to include latches having additional stages, or for the hatch to be entirely devoid of latches.

It is also noted that shifting of the cover or a portion thereof among its closed, venting, and open positions may in some instances occur without each of the latch components being in an identical configuration. For instance, a portion of the cover might shift to the intermediate venting position upon the operation of an adjacent set of the latch components to the intermediate configuration, with the remainder of the cover remaining in the closed position due to the remaining latch components being in a closed configuration.

In operation of a preferred embodiment of the present invention, a user preferably first shifts each of the latch components 82 of the hatch 12 to the intermediate configuration. If necessary, the cover 22 is then permitted to shift away from the base 16 via axial shifting in the slots 46 to thereby form the venting gap 84 between the inner shell surface 68 and the gasket 32, with pressure from the chamber 14 being released or a vacuum in the chamber 14 being neutralized via the venting gap 84. Some shifting of the cover 22 may occur simply by the gasket 32 being removed from compression. The user then shifts each of the latch components 82 radially outwardly to the open configuration, grasps the handle 62, and lifts the cover 22 such that it pivots relative to the base 16 via the hinge assembly 34. The cover 22 is preferably at least substantially free from fluid-related degradation due to the shell 66 yet retains sufficient strength for the application due at least in part to the plate 64. When the cover 22 is in the fully open position, the arms 44 abut the stopper bar 56, preventing any further rotation, and the opening 20 is at least substantially unobstructed. During the opening process and while the cover 22 is held in the open position, the drip lip 72 directs any fluid or condensate that falls from the cover 22 or is otherwise directed thereon into the opening 22 and, in turn, into the chamber 14. Maintenance work or other procedures associated with the tank 10 may then be performed as necessary.

The preferred forms of the invention described above are to be used as illustration only and should not be utilized in a limiting sense in interpreting the scope of the present invention.

The inventors hereby state their intent to rely on the Doctrine of Equivalents to determine and assess the reasonably fair scope of the present invention as pertains to any apparatus not materially departing from but outside the literal scope of the invention set forth in the following claims.

What is claimed is:

1. A manway hatch for use with a tank defining a chamber in which fluid is stored or transported, said manway hatch comprising:

a base configured to be fixed to the tank, said base defining an opening configured to communicate with the tank chamber; and a cover shiftable between a closed position, in which the cover is in a covering relationship with the opening in the base, and an open position, in which the opening is substantially unobstructed by the cover so as to permit chamber ingress and egress through the opening, said cover including an inner cover surface that generally faces the opening when the cover is in the closed position, said base and said inner cover surface being at least substantially formed of a synthetic resin, said cover including an arcuately extending drip lip projecting from the inner cover surface, such that the drip lip extends into the opening when the cover is in the closed position and extends at least in part over the opening when the cover is in the open position, said drip lip comprising a concave body with a pair of generally arcuately spaced apart side retaining walls, said body extending only partly around the inner cover surface.

2. The manway hatch of claim 1, said cover including a metal plate which at least substantially spans the opening when said cover is in the closed position, said cover including a corrosion-resistant, shell encapsulating the plate, such that the shell comprises the inner cover surface and is formed of said synthetic resin, said cover including at least one fastener, said at least one fastener projecting from the plate and at least partially through the shell.

3. The manway hatch of claim 2, said plate defining a plurality of perforations therethrough, said shell filling each of said perforations.

4. The manway hatch of claim 2, said plate being molded in the shell.

5. The manway hatch of claim 2, said cover further comprising a plurality of latch components, each of which is shiftable between a latched position and an unlatched position, said latch components securing the cover to the base when the cover is in the closed position and the latch components are in the latched position and said latch components allowing movement of the cover from the closed position when the latch components are in the unlatched position.

6. The manway hatch of claim 2, said plate comprising stainless steel.

7. The manway hatch of claim 2, said synthetic resin comprising ultra high molecular weight polyethylene.

8. The manway hatch of claim 2, said cover further including a handle, said at least one fastener securing the handle to the plate.

9. The manway hatch of claim 1, said manway hatch further including a hinge pivotally interconnecting the base and the cover, said drip lip positioned adjacent the hinge.

10. The manway hatch of claim 1, said drip lip being at least substantially formed of said synthetic resin.

11. The manway hatch of claim 10, said base, said inner cover surface, and said drip lip being at least substantially formed of said synthetic resin which comprises ultra high molecular weight polyethylene.

* * * * *